US010915059B2

(12) United States Patent
Ohashi

(10) Patent No.: US 10,915,059 B2
(45) Date of Patent: Feb. 9, 2021

(54) IMAGE FORMING APPARATUS

(71) Applicant: KYOCERA Document Solutions Inc., Osaka (JP)

(72) Inventor: Hiroaki Ohashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/896,937

(22) Filed: Jun. 9, 2020

(65) Prior Publication Data

US 2020/0393789 A1 Dec. 17, 2020

(30) Foreign Application Priority Data

Jun. 13, 2019 (JP) ..... 2019-110508

(51) Int. Cl.
*G03G 21/16* (2006.01)

(52) U.S. Cl.
CPC ..... *G03G 21/1647* (2013.01); *G03G 21/1676* (2013.01)

(58) Field of Classification Search
CPC ..... G03G 21/18; G03G 21/1642; G03G 21/1647; G03G 21/1671; G03G 21/1676; G03G 21/1803; G03G 21/1817; G03G 21/1821; G03G 21/1825; G03G 21/1842; G03G 21/1857; G03G 2221/1678; G03G 2221/1853; G03G 2221/1861
See application file for complete search history.

(56) References Cited

U.S. PATENT DOCUMENTS

2012/0063808 A1* 3/2012 Matsuda ..... G03G 21/1647 399/111
2014/0301753 A1* 10/2014 Fujii ..... G03G 21/1821 399/110
2015/0362889 A1 12/2015 Ohashi et al.
2016/0378018 A1* 12/2016 Goda ..... G03G 15/0806 399/279
2017/0315498 A1* 11/2017 Abe ..... G03G 21/1647

FOREIGN PATENT DOCUMENTS

JP 2016-14854 A 1/2016

* cited by examiner

*Primary Examiner* — Thomas S Giampaolo, II
(74) *Attorney, Agent, or Firm* — Stein IP, LLC

(57) ABSTRACT

The image forming apparatus includes an image carrier unit, a developing device, a unit support frame, and a developing holder. The developing holder is provided on the unit support frame, and holds the developing device such that the developing device is swingable in a direction that allows the developer carrier to get nearer to or further separate from the image carrier. The developing holder includes a driving gear and a pair of swinging shaft parts. The driving gear transmits motive power to the developing device. The pair of swinging shaft parts have a rotational axis extending parallel to an axial direction of the developer carrier and are supported rotatable relative to the unit support frame. An axial distance between the pair of swinging shaft parts is longer than a distance from a rotational center of the driving gear to a rotational center of the swinging shaft parts.

5 Claims, 9 Drawing Sheets

IMAGE FORMING APPARATUS

INCORPORATION BY REFERENCE

This application is based upon and claims the benefit of priority from the corresponding Japanese Patent Application No. 2019-110508 filed on Jun. 13, 2019, the entire contents of which are incorporated herein by reference.

BACKGROUND

The present disclosure relates to an image forming apparatus.

Wth electrophotographic type image forming apparatuses such as copiers and printers, there are some cases where a drum unit (image carrier unit) including a photosensitive drum (image carrier) is replaced with another due to service life of the photosensitive drum, for example, when a specified number of printed sheets has been reached. In other cases, there may arise a need for maintenance or replacement of a developing device as well which is placed in adjacency to the drum unit. For these reasons, the drum unit and the developing device may be provided so as to be respectively and independently fittable to and removable from the image forming apparatus.

For example, a conventional image forming apparatus includes a retainer which is an opening/closing member provided on a frontal side of an image carrier unit and a developing device. The retainer, i.e. opening/closing member, when closed, causes the image carrier unit and the developing device to be fitted to a unit support frame so that an image carrier is positioned, and the retainer, when opened, causes the image carrier to be released from the positioned state. The image forming apparatus further includes a developing-device moving mechanism. The developing-device moving mechanism, during positioning of the image carrier by the retainer, sets the developing device to a developing position where a developer carrier comes into contact with or proximity to the image carrier, and during releasing of the image carrier from its positioning, sets the developing device to a separate position where the developer carrier goes separate from the image carrier. As a result of this, fitting and removal operations of the image carrier unit and the developing device to and from the image forming apparatus main body can be fulfilled smoothly and securely.

SUMMARY

An image forming apparatus according to one aspect of the present disclosure includes an image carrier unit, a developing device, a unit support frame, and a developing holder. The image carrier unit includes an image carrier. The developing device includes a developer carrier for supplying toner onto the image carrier, and is placed in adjacency to the image carrier unit. The unit support frame supports the image carrier unit and the developing device such that the image carrier unit and the developing device are fittable thereto and removable therefrom individually. The developing holder is provided on the unit support frame, and holds the developing device such that the developing device is swingable in a direction that allows the developer carrier to get nearer to or further separate from the image carrier. The developing holder includes a driving gear and a pair of swinging shaft parts. The driving gear transmits motive power to the developing device. The pair of swinging shaft parts have a rotational axis extending parallel to an axial direction of the developer carrier, and are supported rotatable relative to the unit support frame. An axial distance between the pair of swinging shaft parts is longer than a distance from a rotational center of the driving gear to a rotational center of the swinging shaft parts.

DETAILED DESCRIPTION

Hereinbelow, an embodiment of the present disclosure will be described with reference to the accompanying drawings. It should be noted that this disclosure is not limited to contents of the following description.

Figure 1:
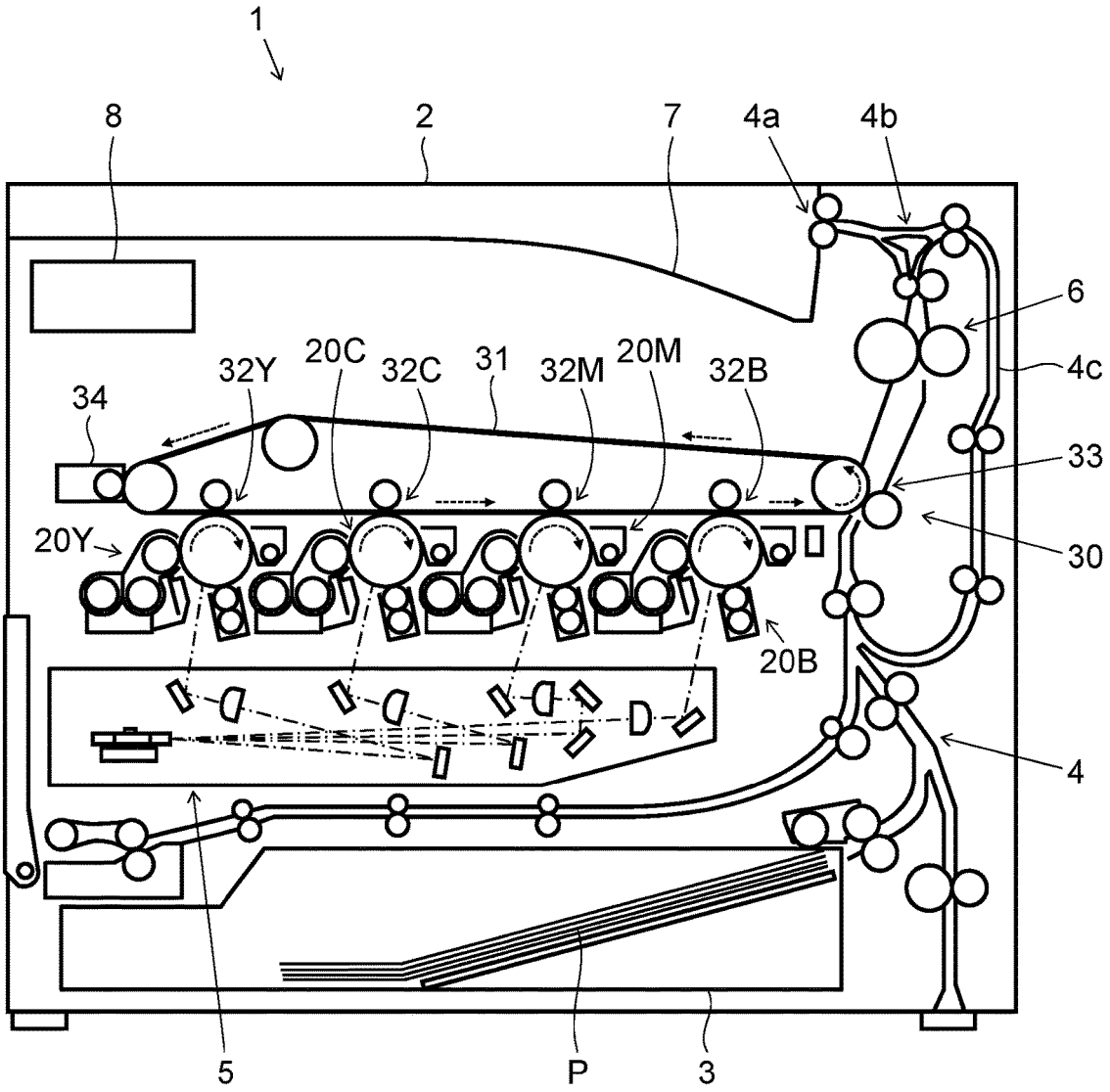
FIG. 1 is a schematic cross-sectional front view showing a configuration of an image forming apparatus according to an embodiment of the present disclosure.
Figure 2:
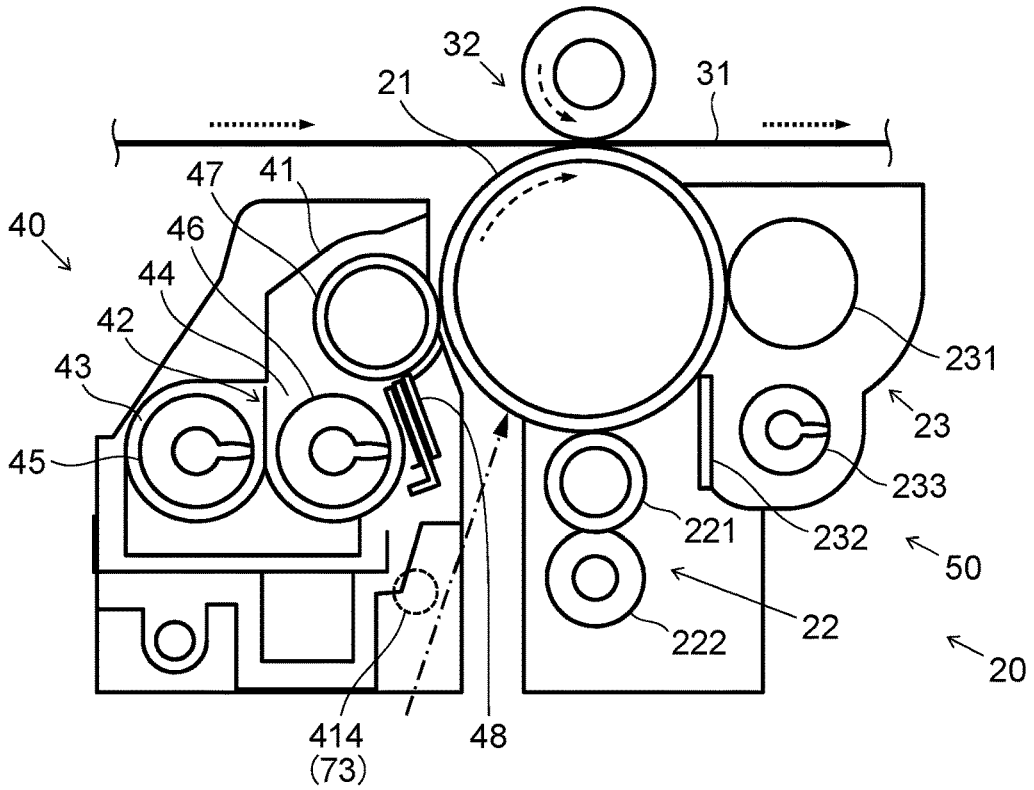
FIG. 2 is a cross-sectional front view showing a vicinity of an image forming part in the image forming apparatus according to an embodiment of the disclosure.

FIG. 1 is a schematic cross-sectional front view showing a configuration of an image forming apparatus 1 which is an embodiment. FIG. 2 is a cross-sectional front view showing a vicinity of an image forming part 20 in the image forming apparatus 1. Hereinbelow, it is assumed that an up/down direction, a left/right direction, and a drawing-sheet depthwise direction of FIG. 1 refer to an up/down direction, a left/right direction, and a front/rear direction of the image forming apparatus 1, respectively. These directional definitions should not be construed as limiting the in-use orientation and positional relationships of the image forming apparatus 1.

An example of the image forming apparatus 1 according to this embodiment is a tandem type color printer in which toner images are transferred onto a paper sheet P by using an intermediate transfer belt 31. The image forming apparatus 1 may be a so-called multifunction peripheral equipped with printing, scanning (image reading), facsimile transmission, and other functions, as an example.

As shown in FIGS. 1 and 2, the image forming apparatus 1 includes a sheet feed part 3, a sheet conveyance part 4, an exposure part 5, image forming parts 20, a transfer part 30, a fixing part 6, a sheet discharge part 7, and a controller 8, as these components are provided in a main body 2 of the image forming apparatus 1.

The sheet feed part 3, in which a plurality of paper sheets P are contained, feeds out the sheets, one by one separately, in printing operation. The sheet conveyance part 4 conveys a sheet P, which has been fed out from the sheet feed part 3, to a secondary transfer part 33 and the fixing part 6, and further discharges the sheet P, which has been subjected to fixing process, through a sheet discharge opening 4*a* onto the sheet discharge part 7. In a case where double-sided printing is executed, the sheet conveyance part 4 distributes a sheet P, which has been subjected to fixation of its first surface, to a reversal conveyance part 4*c* by a branch part 4*b* so that the sheet P is conveyed again to the secondary transfer part 33 and the fixing part 6. The exposure part 5 applies laser light, which is controlled based on image data, toward the image forming parts 20.

The image forming parts 20 include a yellow-color image forming part 20Y, a cyan-color image forming part 20C, a magenta-color image forming part 20M, and a black-color image forming part 20B. These four image forming parts 20 are identical in basic structure thereamong. Therefore, hereinafter, identification signs 'Y', 'C', 'M' and 'B' representing individual colors, respectively, may be omitted unless particular designation thereamong is needed.

Each image forming part 20 includes a photosensitive drum (image carrier) 21 which is supported so as to be rotatable in a specified direction (clockwise in FIGS. 1 and 2). The image forming part 20 further includes a charging part 22, a developing device 40 and a drum cleaning part 23, these members being placed around the photosensitive drum 21 along its rotational direction. In addition, a primary transfer part 32 is placed between the developing device 40 and the drum cleaning part 23.

The charging part 22 makes an outer circumferential surface of the photosensitive drum 21 electrically charged to a specified potential by a charging roller as an example. Then, an electrostatic latent image of a document image is formed on the outer circumferential surface of the photosensitive drum 21 by the laser light applied from the exposure part 5. The developing device 40 supplies toner to the electrostatic latent image to make the image developed, forming a toner image. The four image forming parts 20 form toner images of different colors, respectively.

The transfer part 30 includes the intermediate transfer belt 31, primary transfer parts 32Y, 32C, 32M, 32B, the secondary transfer part 33, and a belt cleaning part 34. The intermediate transfer belt 31 is an intermediate transfer member which is supported so as to be rotatable in a specified direction (counterclockwise in FIG. 1) and onto which toner images formed by the four image forming parts 20, respectively, are primarily transferred successively in superimposition. The four image forming parts 20 are placed in such a so-called tandem system as to be arrayed in one line from upstream toward downstream side in a rotational direction of the intermediate transfer belt 31.

The primary transfer parts 32Y, 32C, 32M, 32B are placed above the individual-color image forming parts 20Y, 20C, 20M, 20B, respectively. The secondary transfer part 33 is placed at a site which is sheet-conveyance upstream of the fixing part 6 in the sheet conveyance part 4 and moreover which is, as viewed in the rotational direction of the intermediate transfer belt 31, downstream of the individual-color image forming parts 20Y, 20C, 20M, 20B in the transfer part 30. The belt cleaning part 34 is placed at a site which is upstream of the individual-color image forming parts 20Y, 20C, 20M, 20B in the rotational direction of the intermediate transfer belt 31.

Toner images are primarily transferred onto the outer circumferential surface of the intermediate transfer belt 31 by the individual-color primary transfer parts 32Y, 32C, 32M, 32B, respectively. Then, the toner images of the individual image forming parts 20 are transferred onto the intermediate transfer belt 31 successively in superimposition at specified timings along with the rotation of the intermediate transfer belt 31. As a result, a color toner image in which the four-color toner images of yellow, cyan, magenta and black have been superimposed together is formed on the outer circumferential surface of the intermediate transfer belt 31. The drum cleaning part 23 performs cleaning by eliminating toner and the like remaining on the outer circumferential surface of the photosensitive drum 21 after the primary transfer process.

At a secondary-transfer nip portion formed in the secondary transfer part 33, the color toner image on the outer circumferential surface of the intermediate transfer belt 31 is transferred onto the sheet P that has been delivered synchronously by the sheet conveyance part 4. The belt cleaning part 34 performs cleaning by eliminating toner and the like remaining on the outer circumferential surface of the intermediate transfer belt 31 after the secondary transfer process.

The fixing part 6 heats and pressurizes the sheet P with the toner image transferred thereon so that the toner image is fixed on the sheet P.

The controller 8 includes a CPU, an image processing part, and a storage part, which are not shown, as well as other unshown electronic circuits and electronic components. Based on control-dedicated programs and data stored in the storage part, the CPU control operations of individual components provided in the image forming apparatus 1 to perform processes relating to functions of the image forming apparatus 1. The sheet feed part 3, the sheet conveyance part 4, the exposure part 5, the image forming parts 20, the transfer part 30, and the fixing part 6 individually receive instructions from the controller 8 to perform printing on the sheet P in linkage with one another. The storage part is made up, for example, in combination of program ROM (Read Only Memory), data ROM or other nonvolatile storage devices and RAM (Random Access Memory) or other volatile storage devices (these storage devices are not shown).

Figure 3:
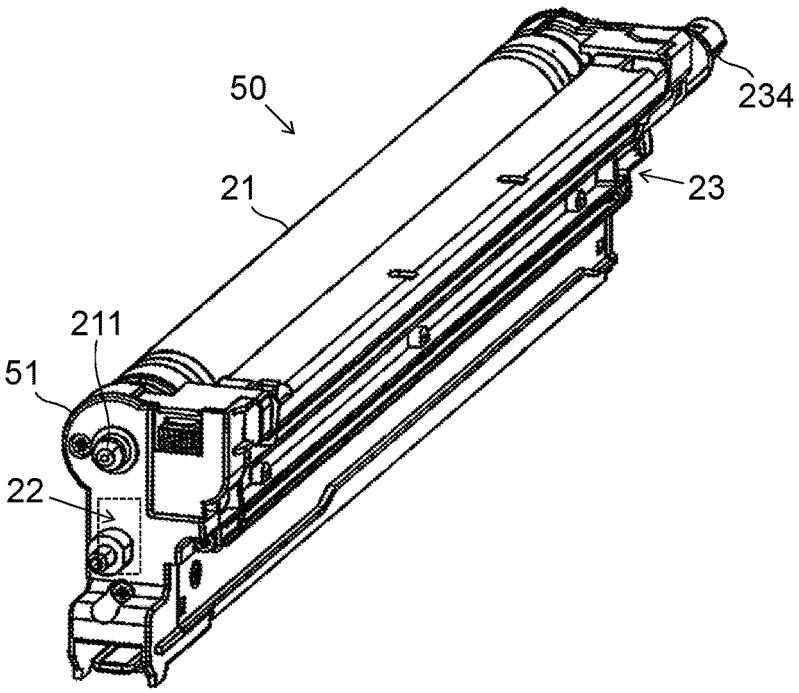
FIG. 3 is a perspective view of a drum unit in the image forming apparatus according to an embodiment of the disclosure.
Figure 4:
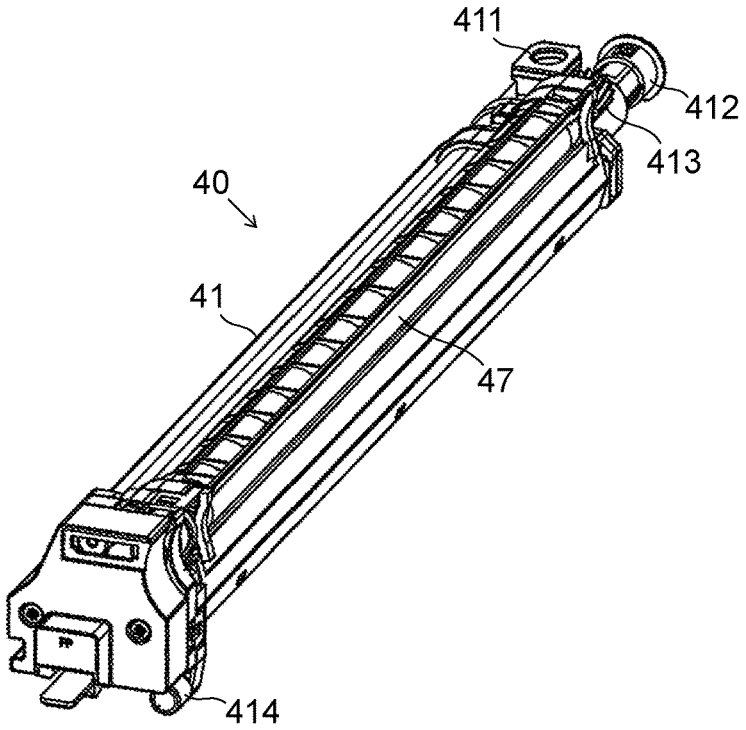
FIG. 4 is a perspective view of a developing device in the image forming apparatus according to an embodiment of the disclosure.

Next, a configuration of each image forming part 20 as well as its peripheries will be described. FIG. 3 is a perspective view of a drum unit 50 in the image forming apparatus 1. FIG. 4 is a perspective view of a developing device 40 in the image forming apparatus 1. Because the individual-color image forming parts 20 are identical in basic configuration thereamong, addition of identification signs representing individual colors of the component parts as well as their description may be omitted below unless particular designation thereamong is needed.

As described before, the image forming part 20 includes the photosensitive drum 21, the charging part 22, the developing device 40 and the drum cleaning part 23 shown in FIG. 2. Out of these component members, the photosensitive drum 21, the charging part 22 and the drum cleaning part 23 are unitized so as to be structured as a drum unit (image carrier unit) 50. That is, the image forming part 20 includes the drum unit 50 and the developing device 40.

The drum unit 50 is fittable to and removable from the main body 2 of the image forming apparatus 1. The drum unit 50, as shown in FIGS. 2 and 3, includes the photosensitive drum 21, the charging part 22 and the drum cleaning part 23 provided in a casing 51 of the drum unit 50.

The photosensitive drum 21, which is of a cylindrical shape having a drum shaft 211 serving as a rotational center axis, is positioned with the rotational axis set horizontal. The photosensitive drum 21 is rotatably supported, via the drum shaft 211, by an unshown bearing part provided in the casing 51 of the drum unit 50.

The charging part 22 includes a charging roller 221 and a charge cleaning roller 222. The charging roller 221 is set in contact with an outer circumferential surface of the photosensitive drum 21 so as to apply a specified charging bias onto the outer circumferential surface of the photosensitive drum 21. The charge cleaning roller 222 is set in contact with an outer circumferential surface of the charging roller 221 so as to fulfill cleaning of the outer circumferential surface of the charging roller 221.

The drum cleaning part 23 includes a cleaning roller 231, a cleaning blade 232 and a collecting spiral 233. The cleaning roller 231 is set in contact with the outer circumferential surface of the photosensitive drum 21 at a specified pressure. The cleaning roller 231 is rotated by an unshown motor in such a direction that a contact area with the photosensitive drum 21 is moved in the same direction as the photosensitive drum 21. The cleaning blade 232 is placed downstream of the cleaning roller 231 in the drum rotational direction. The cleaning blade 232 is set in contact with the outer circumferential surface of the photosensitive drum 21 at a specified pressure. The cleaning roller 231 and the cleaning blade 232 perform cleaning by eliminating toner and the like remaining on the outer circumferential surface of photosensitive drum 21 after the primary transfer process. The collecting spiral 233 conveys waste toner and the like, which have been eliminated from the outer circumferential surface of the photosensitive drum 21, to an unshown waste toner collecting container provided outside the drum cleaning part 23.

The drum cleaning part 23 further includes a waste toner discharge part 234. The waste toner discharge part 234 is placed at a back face portion of the drum cleaning part 23 so as to be protruded rearward. Waste toner and the like eliminated from the outer circumferential surface of the photosensitive drum 21 are discharged from the waste toner discharge part 234 by rotation of the collecting spiral 233, and then conveyed up to the unshown waste toner collecting container.

The developing device 40 is fittable to and removable from the main body 2 of the image forming apparatus 1. The developing device 40 is placed in adjacency to the drum unit 50. As shown in FIGS. 2 and 4, the developing device 40 includes a developing container 41, a partition 42, a stirring conveyance chamber 43, a supply conveyance chamber 44, a stirring conveyance member 45, a supply conveyance member 46, a developing roller (developer carrier) 47, and a restricting blade 48.

The developing container 41 contains, for example, a two-component developer containing toner and magnetic carrier as a developer to be supplied from the developing device 40 to the outer circumferential surface of the photosensitive drum 21. The developing container 41, which is formed into an elongate shape extending along the rotational-axis direction of the photosensitive drum 21 (i.e. drawing-sheet depthwise direction of FIG. 2; hereinafter, referred to as axial direction), is placed with its longitudinal direction set horizontal.

The developing container 41 has a developer supply port 411 and a developer discharge part 412 shown in FIG. 4. The developer supply port 411 and the developer discharge part 412 are placed at a back face portion of the developing container 41 so as to be protruded rearward. The developer supply port 411 communicates with a later-described stirring conveyance chamber 43. When the developing device 40 is fitted to the main body 2, the developer supply port 411 is connected to a developer supply path 713 of a later-described developing holder 70. Via the developer supply path 713 and the developer supply port 411, the developing device 40 is supplied or resupplied with the developer from an unshown developer container provided in the main body 2. The developer discharge part 412 communicates with a later-described supply conveyance chamber 44. The developing device 40 discharges excess developer inside the developing container 41 through the developer discharge part 412 out of the developing container 41.

The developing container 41 also includes an input gear 413 shown in FIG. 4. The input gear 413 is placed on a rear end side of the developing container 41 as viewed in an axial direction of the developing roller 47. The input gear 413 is provided so as to be rotatable about an axis extending parallel to the axial direction of the developing roller 47. An unshown input driven gear which is rotated along with rotation of the input gear 413 is provided so as to be coaxial with the input gear 413. Also, an unshown developing gear which meshes with the input driven gear is provided so as to be coaxial with the developing roller 47. As the input gear 413 is rotated, the developing roller 47 is rotated via the input driven gear and the developing gear.

The developing container 41 further includes a developing support-shaft part 414 shown in FIGS. 2 and 4. The developing support-shaft part 414 is placed on one side of the developing container 41 closer to the photosensitive drum 21 as viewed in a direction crossing the axial direction of the developing roller 47 (i.e. in the left/right direction). The developing support-shaft part 414 is placed on a front side of the developing container 41 as well as on a lower side of the developing roller 47. The developing support-shaft part 414 extends along the axial direction of the developing roller 47. The developing support-shaft part 414 is rotatable relative to a later-described unit support frame 60.

The partition 42 is provided at a lower portion inside the developing container 41. The partition 42 is provided at a generally central portion of the lower portion of the developing container 41 in a direction crossing its axial direction (i.e. in the left/right direction in FIG. 2), and extends in both the axial direction and the up/down direction. The partition 42 partitions the interior of the developing container 41 in a direction crossing the axial direction. The partition 42 includes unshown developer communicating openings placed at both end portions in the axial direction, respectively.

The stirring conveyance chamber 43 and the supply conveyance chamber 44 are provided inside the developing container 41. The stirring conveyance chamber 43 and the supply conveyance chamber 44 are formed by internal division of the developing container 41 made by the partition 42. The supply conveyance chamber 44 is placed in lower adjacency to a placement area of the developing roller 47 inside the developing container 41. The stirring conveyance chamber 43 is placed at an area inside the developing container 41 which is more separate from the developing roller 47 than the supply conveyance chamber 44. The stirring conveyance chamber 43 is supplied with the developer through the developer supply port 411.

The stirring conveyance member 45 is placed inside the stirring conveyance chamber 43. The supply conveyance member 46 is placed inside the supply conveyance chamber 44. The stirring conveyance member 45 and the supply conveyance member 46 are supported by the developing container 41 so as to be rotatable about their axes each extending parallel to the photosensitive drum 21. The stirring conveyance member 45 and the supply conveyance member 46 are rotated about the axes to stir and convey the developer along their rotational-axis directions, respectively.

By the rotation of the stirring conveyance member 45 and the supply conveyance member 46, the developer, passing through the developer communicating openings placed at both axial ends of the partition 42, is circulated between the stirring conveyance chamber 43 and the supply conveyance chamber 44. In the stirring conveyance chamber 43 and the supply conveyance chamber 44, toner (positively charged toner) supplied from outside is mixed with magnetic carrier, stirred and electrically charged.

The developing roller 47 is placed above the supply conveyance member 46 inside the developing container 41. The developing roller 47 is supported by the developing container 41 so as to be rotatable about an axis extending parallel to the photosensitive drum 21. The developing roller 47 includes a cylindrical-shaped developing sleeve rotatable counterclockwise in FIG. 2, and a developing roller-side magnetic pole fixed within the developing sleeve (both members are unshown). Specified biases of a DC voltage (hereinafter, referred to as VslvDC) and an AC voltage (hereinafter, referred to as VslvAC) are applied to the developing roller 47. Part of the outer circumferential surface of the developing roller 47 is exposed out of the developing container 41 and opposed to the photosensitive drum 21. The developing roller 47 carries, in its opposing area to the photosensitive drum 21, toner which is to be supplied to the outer circumferential surface of the photosensitive drum 21.

The restricting blade 48 is closely opposed to the developing roller 47 and placed so as to form a specified space between its fore end and the outer circumferential surface of the developing roller 47. The restricting blade 48 is placed on an upstream side of the opposing area between the developing roller 47 and the photosensitive drum 21 as viewed in the rotational direction of the developing roller 47. The restricting blade 48 extends over an entire length of the developing roller 47 in its axial direction (i.e. drawing-sheet depthwise direction of FIG. 2). The restricting blade 48 restricts layer thickness of the developer carried on the outer circumferential surface of the developing roller 47.

The developer is stirred, circulated, and electrically charged by the stirring conveyance member 45 and the supply conveyance member 46 in the stirring conveyance chamber 43 and the supply conveyance chamber 44, and then delivered to the developing roller 47 by the supply conveyance member 46. On the outer circumferential surface of the developing roller 47, an unshown magnetic brush composed of the toner and the magnetic carrier is formed. The magnetic brush, after restricted in layer thickness by the restricting blade 48, is conveyed to the opposing area between the developing roller 47 and the photosensitive drum 21 by the rotation of the developing roller 47. Then, due to potential differences between the specified biases (VslvDC and VslvAC) applied to the developing roller 47 and the photosensitive drum 21, toner flies from the developing roller 47 to the photosensitive drum 21, causing an electrostatic latent image on the outer circumferential surface of the photosensitive drum 21 to be developed.

Figure 5:
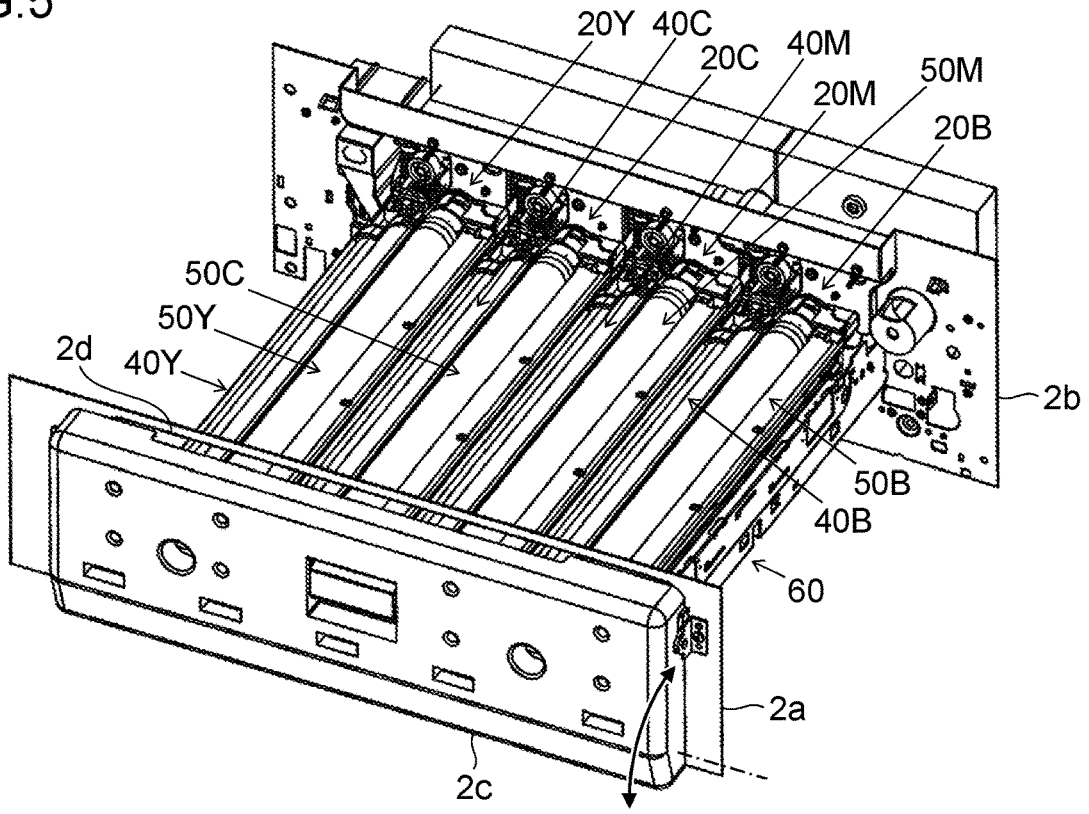
FIG. 5 is a perspective view showing an arrangement of four image forming parts in the image forming apparatus according to an embodiment of the disclosure.

FIG. 5 is a perspective view showing an arrangement of the four image forming parts 20 in the image forming apparatus 1. The image forming apparatus 1 includes a unit support frame 60 shown in FIG. 5.

The unit support frame 60 is placed between a front-side frame 2*a* and a back-side frame 2*b* of the main body 2. The unit support frame 60 supports the drum units 50 and the developing devices 40 of the four image forming parts 20, respectively, so as to allow the drum units 50 and the developing devices 40 to be fittable and removable individually.

An opening/closing cover 2*c* is placed at a front of the front-side frame 2*a*. The opening/closing cover 2*c* is supported so as to be pivotable up and down relative to the front-side frame 2*a* on a fulcrum given by an unshown hinge portion which is provided at a lower end portion of the opening/closing cover 2*c* and which extends horizontally in the left/right direction. The opening/closing cover 2*c* opens and closes an opening 2*d* provided in the front-side frame 2*a*. Wth the opening/closing cover 2*c* opened, the drum units 50 and the developing devices 40 can be set in and out through the opening 2*d* from the front side of the image forming apparatus 1.

Figure 6:
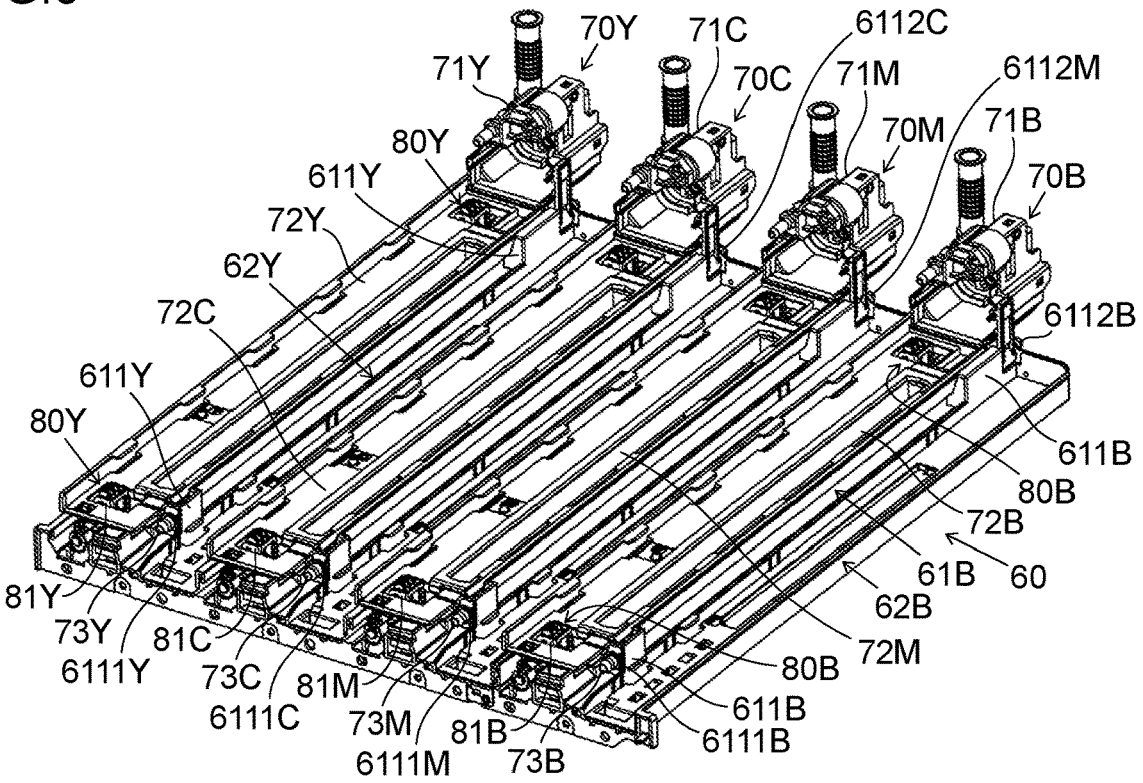
FIG. 6 is a perspective view of a unit support frame in the image forming apparatus according to an embodiment of the disclosure.

FIG. 6 is a perspective view of the unit support frame 60 in the image forming apparatus 1. As shown in FIG. 6, the unit support frame 60 includes developing-device support parts 61, drum-unit support parts 62, developing holders 70, and developing-device moving mechanisms 80.

The developing-device support parts 61 are areas of the unit support frame 60 located under the four developing devices 40, respectively. Each of the developing-device support parts 61 includes holder connecting parts 611.

The holder connecting parts 611 are placed on one side of the developing-device support part 61 closer to the drum unit 50 as viewed in a direction crossing the axial direction of the developing roller 47 (i.e. in the left/right direction). For each one of the four developing devices 40, one pair of the holder connecting parts 611 are placed on front and rear sides, respectively, of the developing device 40.

The front-side holder connecting part 611 has a hole portion 6111 shaped circular in a front view and extending in the axial direction of the developing roller 47 (i.e. in the front/rear direction), for example. The rear-side holder connecting part 611 has a shaft portion 6112 shaped cylindrical and extending in the axial direction of the developing roller 47 (i.e. in the front/rear direction), for example. The hole portions 6111 and the shaft portions 6112 of one pair of holder connecting parts 611 are both placed coaxial with each other, and the developing holder 70 is connected so as to be rotatable about the coaxial line.

The drum-unit support parts 62 are areas of the unit support frame 60 located under the four drum units 50, respectively. Each of the drum-unit support parts 62 is provided as a base placed under the drum unit 50. Each drum-unit support part 62 extends along the drum unit 50 in the axial direction of the photosensitive drum 21 (front/rear direction). The drum unit 50 is mounted on the drum-unit support part 62. The drum-unit support part 62 supports a bottom portion of the drum unit 50.

Each developing holder 70 is fitted to the holder connecting part 611 of the developing-device support part 61. That is, the developing holder 70 is rotatable about the axis of the hole portion 6111 and the shaft portion 6112 of the holder connecting part 611. The developing holder 70 holds the developing device 40. A detailed configuration of the developing holder 70 will be described later.

The developing-device moving mechanisms 80 are placed under front side and rear side, respectively, of the developing device 40, for each one of the four developing devices 40. Each developing-device moving mechanism 80 is placed at a one-side area of the developing device 40 opposed to the drum unit 50 as viewed in a direction crossing the axial direction of the developing roller 47 (i.e. in the left/right direction).

Each of the two developing-device moving mechanisms 80 includes a contact/separable cam 81. A pair of contact/separable cams 81 placed on front side and rear side, respectively, of the unit support frame 60 are mounted on a cam shaft 82, which extends parallel to the developing roller 47, so as to be rotatable synchronously in the same direction. The contact/separable cams 81 are set in contact with the lower face of the developing container 41. Each contact/separable cam 81 is rotated, while keeping in contact with the developing device 40, to cause the developing device 40 to be displaced in the up/down direction, thus making it possible to change the distance between the photosensitive drum 21 and the developing roller 47. That is, the developing-device moving mechanisms 80 function to make the developing device 40 swing about the axis of a swinging shaft part 73 of the later-described developing holder 70, causing the developing roller 47 to get nearer to or further separate from the photosensitive drum 21.

Figure 7:
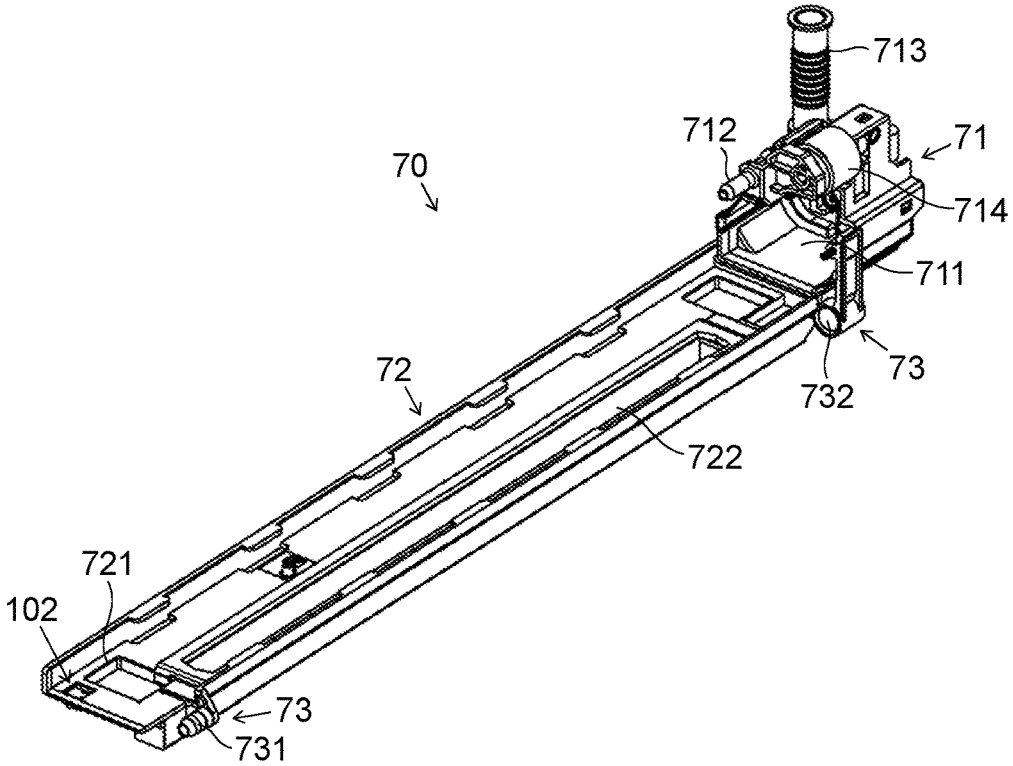
FIG. 7 is a perspective view of a developing holder in the image forming apparatus according to an embodiment of the disclosure.
Figure 8:
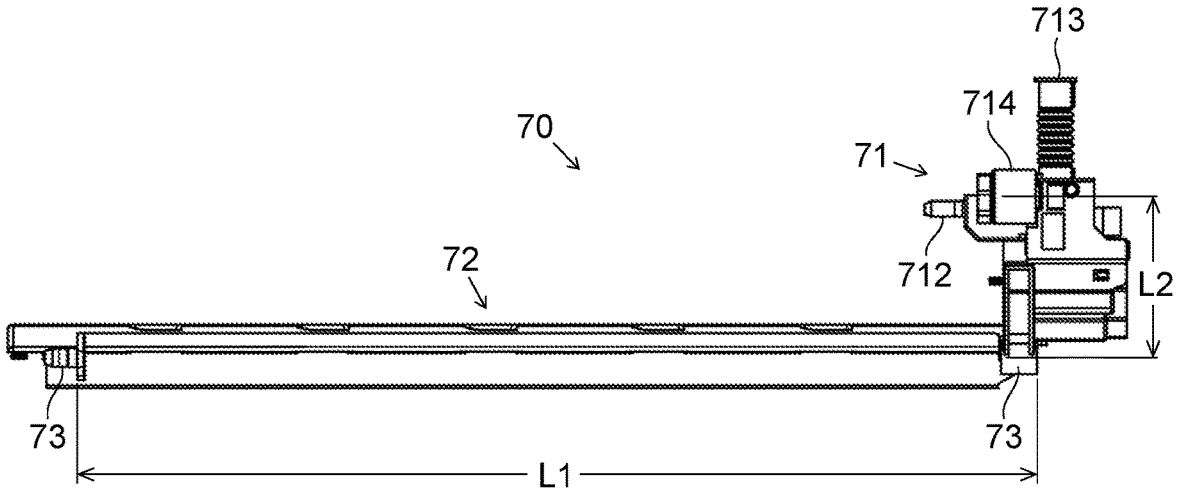
FIG. 8 is a side view of the developing holder in the image forming apparatus according to an embodiment of the disclosure.
Figure 9:
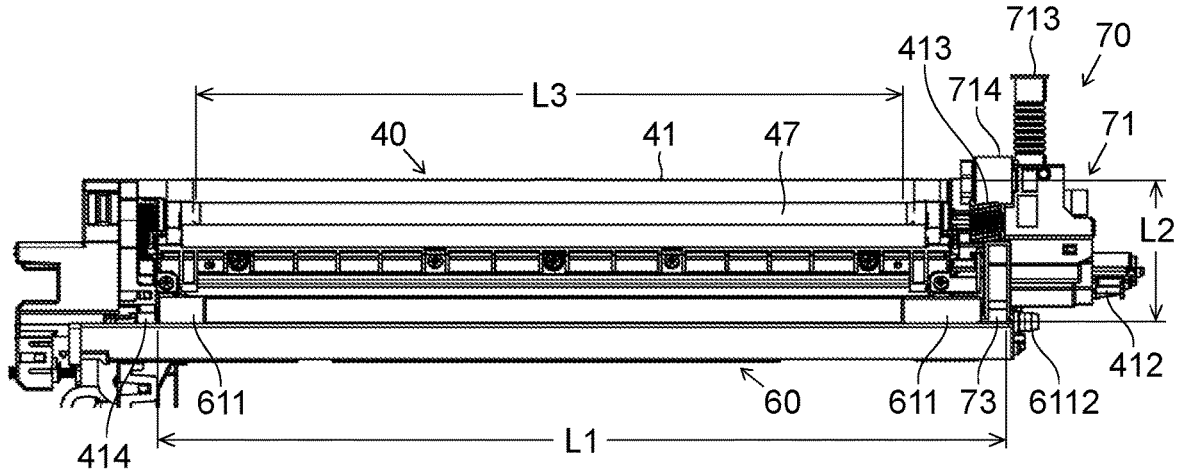
FIG. 9 is a side view of the unit support frame to which the developing device of the image forming apparatus according to an embodiment of the disclosure is fitted.

Next, a detail configuration of the developing holder 70 and its peripheries will be described. FIG. 7 is a perspective view of the developing holder 70 in the image forming apparatus 1. FIG. 8 is a side view of the developing holder 70 in the image forming apparatus 1. FIG. 9 is a side view of the unit support frame 60 to which the developing device 40 of the image forming apparatus 1 is fitted.

As shown in FIGS. 7 and 8, the developing holder 70 includes a rear connecting part 71, a bottom support part 72, and swinging shaft parts 73.

The rear connecting part 71, which is placed at a rear portion of the developing holder 70, is positioned rearward of the developing container 41 when the developing device 40 is fitted to the unit support frame 60 (see FIG. 9). The rear connecting part 71 includes a connecting recess portion 711, a connecting pin 712, a developer supply path 713, and a driving gear 714.

The connecting recess portion 711 is opened at a front portion of the rear connecting part 71 and recessed rearward. The connecting recess portion 711 has an unshown hole portion extending through from inside to outside at a back face portion of the rear connecting part 71. The connecting recess portion 711 comes to house a rear end portion of the developing device 40 when the developing device 40 is fitted to the unit support frame 60. In this state, the developer discharge portion 412 of the developing container 41 is inserted into the hole portion of the connecting recess portion 711 so as to be protruded rearward of the rear connecting part 71 (see FIG. 9).

The connecting pin 712 is provided at a front portion of the rear connecting part 71 so as to be protruded frontward. When the developing device 40 is fitted to the unit support frame 60, the connecting pin 712 is inserted into an unshown hole portion provided in the developing container 41. The connecting pin may be provided in plurality and moreover provided on the developing device 40.

The developer supply path 713 is provided at an upper portion of the rear connecting part 71. The developer supply path 713, which is formed into a cylindrical shape extending in the up/down direction, has a lower end communicating with inside of the connecting recess portion 711. When the developing device 40 is fitted to the unit support frame 60, the lower end of the developer supply path 713 is connected to the developer supply port 411 of the developing container 41.

The driving gear 714 is provided at a front-side upper portion of the rear connecting part 71. When the developing device 40 is fitted to the unit support frame 60, the driving gear 714 is set to such a position as to mesh with the input gear 413 of the developing device 40. The driving gear 714 is provided so as to be rotatable about an axis extending parallel to the axial direction of the developing roller 47. The input gear 413, by meshing with the driving gear 714, has motive power transmitted from the driving gear 714. That is, the driving gear 714 transmits motive power to the developing device 40.

The bottom support part 72, which is placed at a bottom portion of the developing holder 70 frontward of the rear connecting part 71, is positioned under the developing container 41 when the developing device 40 is fitted to the unit support frame 60 (see FIG. 9). The bottom support part 72 extends in both the front/rear direction and the left/right direction. The bottom support part 72 includes cam rise/set openings 721.

The cam rise/set openings 721 are placed on front side and rear side, respectively, of the bottom face of the bottom support part 72. The cam rise/set openings 721 are placed at the same positions in the front/rear direction as the contact/separable cams 81 of the developing-device moving mechanisms 80. Each cam rise/set opening 721 extends through the bottom face of the bottom support part 72 in the up/down direction, allowing the rotating contact/separable cam 81 to rise and set therethrough.

The swinging shaft parts 73 are placed on one side closer to the drum unit 50 than the bottom support part 72 as viewed in the left/right direction. A pair of swinging shaft parts 73 are placed on front side and rear side, respectively, of the bottom support part 72.

The front-side swinging shaft part 73 has, for example, a cylindrical-shaped shaft portion 731 extending in the axial direction of the developing roller 47 (i.e. in the front/rear direction). The rear-side swinging shaft part 73 has, for example, a cylindrical-shaped hole portion 732 extending in the axial direction of the developing roller 47 (i.e. in the front/rear direction). The shaft portion 731 and the hole portion 732 of one pair of swinging shaft parts 73 are placed coaxial with each other, and connected to one pair of holder connecting parts 611 of the unit support frame 60 so as to be rotatable about the axis of the coaxial line. That is, each swinging shaft part 73 has a rotational axis extending in the axial direction of the developing roller 47 (i.e. in the front/rear direction), and is supported rotatable relative to the unit support frame 60.

In more detail, the shaft portion 731 of the front-side swinging shaft part 73 is inserted and connected to the hole portion 6111 of the front-side holder connecting part 611. The shaft portion 6112 of the rear-side holder connecting part 611 is inserted and connected to the hole portion 732 of the rear-side swinging shaft part 73. In addition, the developing support-shaft portion 414 of the developing container 41 is connected to the front-side swinging shaft part 73. In more detail, the developing support-shaft portion 414 is connected to the front-side swinging shaft part 73 at a point frontward of the front-side holder connecting part 611. As a result, the front-side swinging shaft part 73 and the developing support-shaft portion 414 are placed coaxial with the front-side holder connecting part 611.

Wth the above-described configuration, the developing holder 70 holds the developing device 40 such that the developing device 40 is swingable in a direction that allows the developing roller 47 to get nearer to or further separate from the photosensitive drum 21. The developing device 40 and the developing holder 70 swing about the axis of the swinging shaft part 73 synchronously in the same direction.

Figure 10:
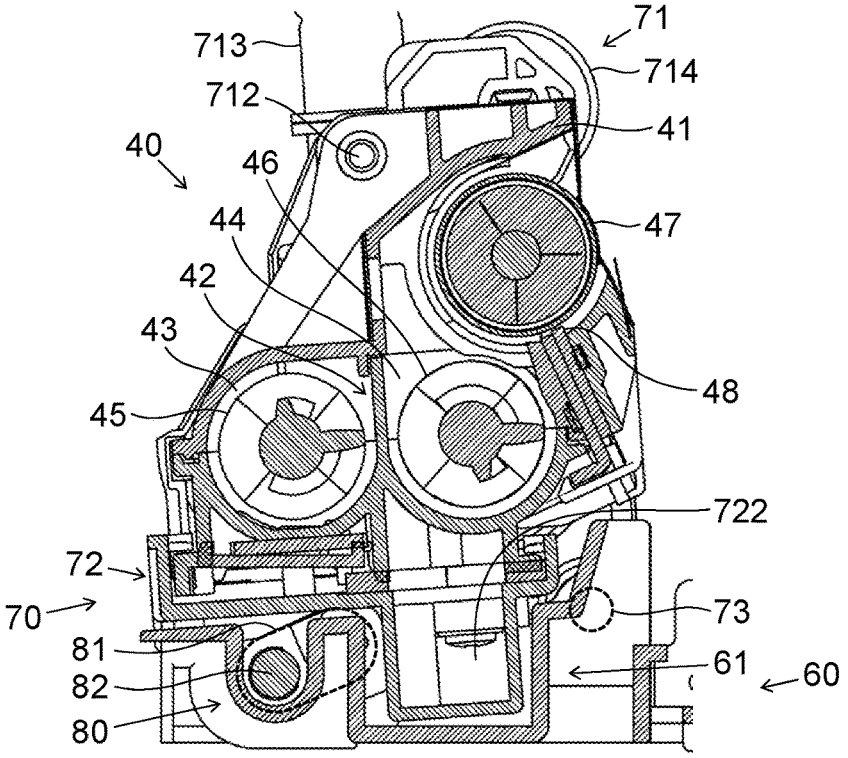
FIG. 10 is a cross-sectional front view of the unit support frame to which the developing device of the image forming apparatus according to an embodiment of the disclosure is fitted, the view showing a state in which a developing roller is separated from a photosensitive drum.

FIG. 10 is a cross-sectional front view of the unit support frame 60 to which the developing device 40 of the image forming apparatus 1 is fitted, the view showing a state in which the developing roller 47 is separated from the photosensitive drum 21. As shown in FIG. 10, the contact/separable cam 81 of the developing-device moving mechanism 80, while in its laid-down state, keeps out of contact with the lower surface of the developing device 40. As a result, the developing device 40 and the developing holder 70 are turned counterclockwise in FIG. 10 about the axis of the swinging shaft part 73 by the action of gravity. As a consequence, the developing roller 47 is separated from the photosensitive drum 21.

Figure 11:
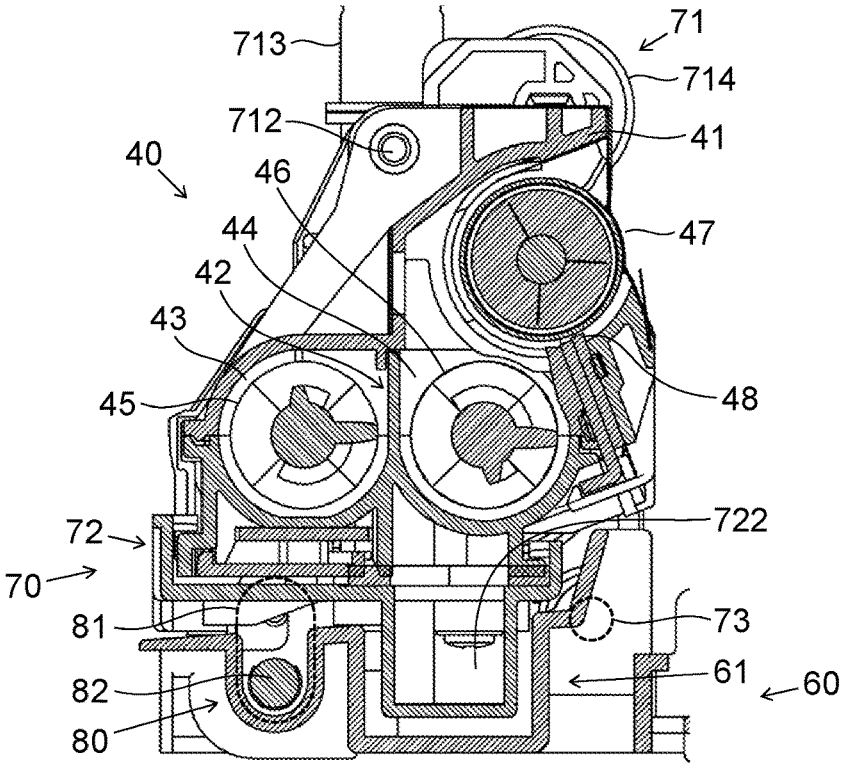
FIG. 11 is a cross-sectional front view of the unit support frame to which the developing device of the image forming apparatus according to an embodiment of the disclosure is fitted, the view showing a state in which the developing roller has got near the photosensitive drum.

FIG. 11 is a cross-sectional front view of the unit support frame 60 to which the developing device 40 of the image forming apparatus 1 is fitted, the view showing a state in which the developing roller 47 has got near the photosensitive drum 21. As shown in FIG. 11, the contact/separable cam 81 of the developing-device moving mechanism 80, while in its raised-up state, keeps in contact with the lower surface of the developing device 40. As a consequence, the developing device 40 and the developing holder 70 are pushed up by the contact/separable cam 81 and turned clockwise in FIG. 11 about the axis of the swinging shaft part 73. Thus, the developing roller 47 gets nearer to the photosensitive drum 21.

Reverting to FIG. 8, an axial distance L1 between a pair of swinging shaft parts 73 is longer than a distance L2 from the rotational center of the driving gear 714 to the rotational center of the swinging shaft part 73. Wth this configuration, the driving gear 714 can be kept from being tilted over when the developing device 40 is fitted to the developing holder 70 of the unit support frame 60. Therefore, the driving gear 714 can be kept from meshing failures, allowing motive power to be favorably transmitted to the developing device 40. That is, occurrence of jitter in images can be suppressed.

As shown in FIG. 9, the axial distance L1 between one pair of swinging shaft parts 73 is longer than an axial length L3 of the developing roller 47. With this configuration, enough length can be ensured for the axial distance L1 between the pair of swinging shaft parts 73. Thus, it becomes possible to enhance the suppressing effect for tilting-over of the driving gear 714 when the developing device 40 is fitted to the developing holder 70 of the unit support frame 60.

As shown in FIGS. 7, 10 and 11, the developing holder 70 includes a cooling duct 722.

The cooling duct 722 is placed on one side of the bottom support part 72 closer to the drum unit 50 as viewed in the left/right direction. The cooling duct 722 is positioned under the supply conveyance chamber 44 of the developing container 41. The cooling duct 722 is formed into a gutter shape which is opened in an upper face portion of the bottom support part 72 and recessed downward and which extends parallel to the axis of the developing roller 47.

Figure 12:
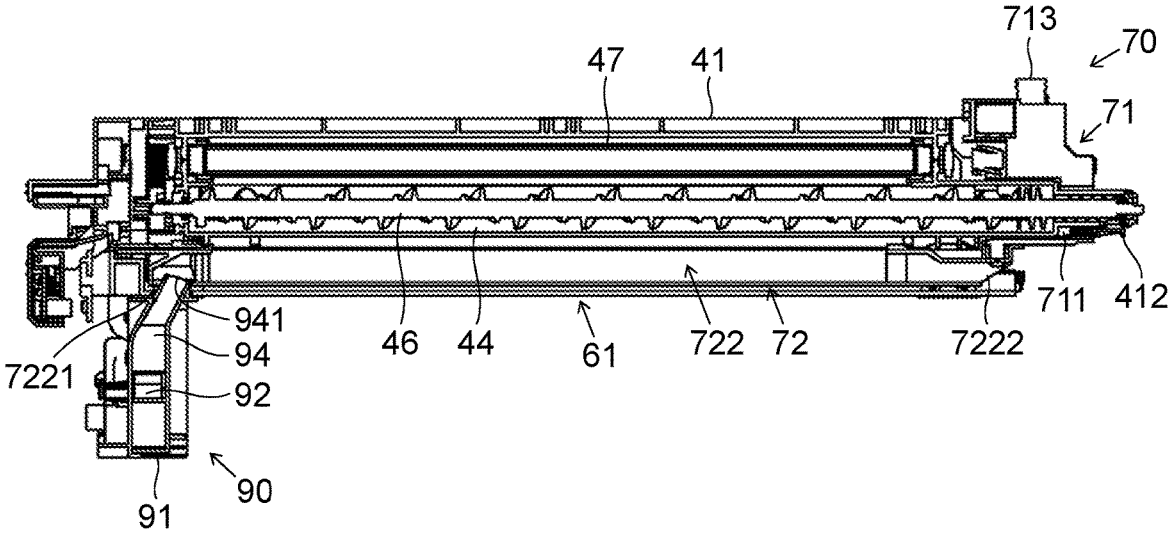
FIG. 12 is a cross-sectional side view of the unit support frame, plus a cooling unit, to which the developing device of the image forming apparatus according to an embodiment of the disclosure is fitted.
Figure 13:
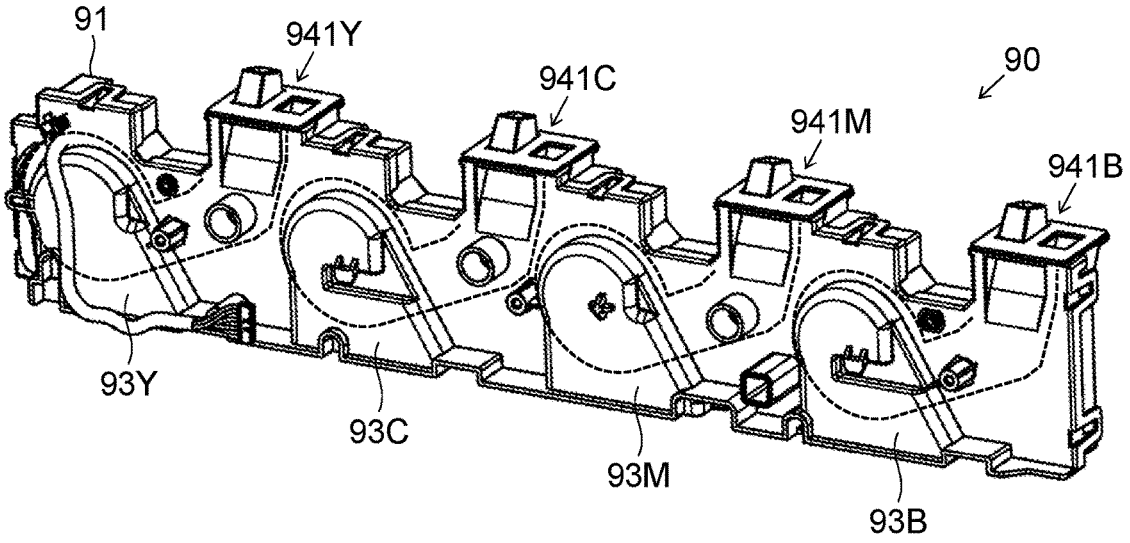
FIG. 13 is an appearance perspective view of the cooling unit in the image forming apparatus according to an embodiment of the disclosure.
Figure 14:
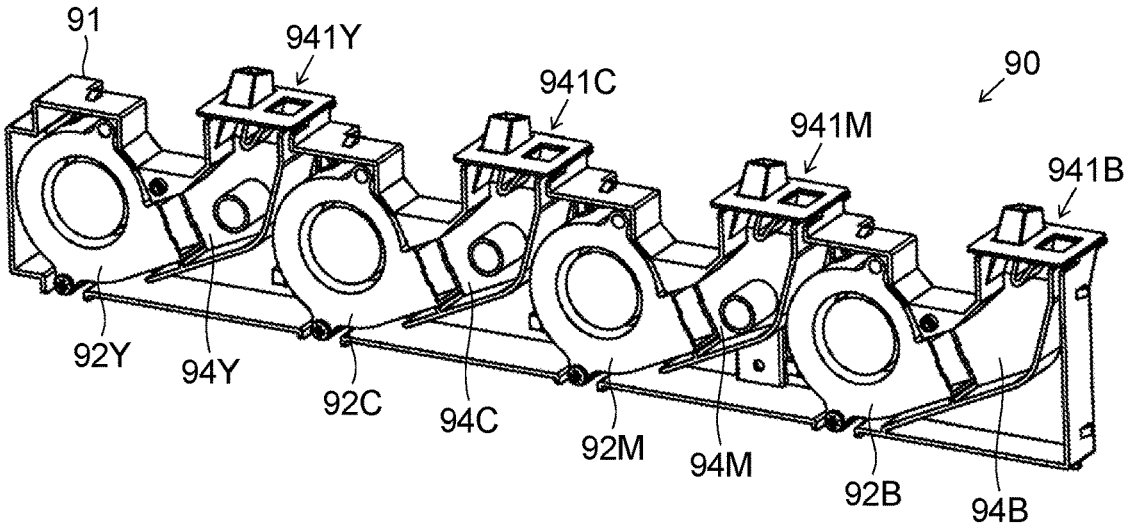
FIG. 14 is a perspective view showing an interior of the cooling unit in the image forming apparatus according to an embodiment of the disclosure.

FIG. 12 is a cross-sectional side view of the unit support frame 60, plus a cooling unit 90, to which the developing device 40 of the image forming apparatus 1 is fitted. FIG. 13 is an appearance perspective view of the cooling unit 90 in the image forming apparatus 1. FIG. 14 is a perspective view showing an interior of the cooling unit 90 in the image forming apparatus 1. The image forming apparatus 1 includes the cooling unit 90 shown in FIGS. 12, 13 and 14.

The cooling unit 90 is placed under a front end-side portion of the unit support frame 60. The cooling unit 90 includes, as provided in its casing 91, blower fans 92, suction ducts 93 and exhaust ducts 94. It is noted that the cooling unit 90 has, in the unitary casing 91, the blower fans 92, the suction ducts 93 and the exhaust ducts 94 individually for the respective four image forming parts 20.

Each blower fan 92, which is a multiblade fan having a scroll-shaped flow passage as an example, is placed inside the casing 91. Each suction duct 93 is connected to the suction side of the blower fan 92, and each exhaust duct 94 is connected to the exhaust side of the blower fan 92. As the blower fan 92 is driven, air is sucked through the suction duct 93, so that an air current that discharges air out of the exhaust duct 94 is generated within the casing 91.

The suction duct 93 is connected to the suction side of the blower fan 92. The suction duct 93 has an unshown suction port in a lower face of the casing 91. As the blower fan 92 is driven, air outside the cooling unit 90 is sucked in through the suction port, so that an air current flowing through the suction duct 93 from the suction port to the blower fan 92 is generated.

The exhaust duct 94 is connected to the exhaust side of the blower fan 92. The exhaust duct 94 has an exhaust port 941 in an upper face of the casing 91. As the blower fan 92 is driven, an air current flowing through the exhaust duct 94 from the blower fan 92 to the exhaust port 941 is generated, so that air is discharged from the exhaust port 941 outward of the cooling unit 90.

As shown in FIG. 12, the cooling duct 722 of the developing holder 70 has an inflow opening 7221 and an outflow opening 7222.

The inflow opening 7221, which is placed in a front-end bottom face of the cooling duct 722, is opened in the up/down direction. A fore end portion of the exhaust duct 94 of the cooling unit 90 at which the exhaust port 941 is provided is inserted into the inflow opening 7221.

The outflow opening 7222, which is placed in a rear-end back face of the cooling duct 722, is opened in the front/rear direction. Another unshown duct which extends up to an unshown exhaust port in the exterior of the main body 2, as an example, is connected to the outflow opening 7222.

As the blower fan 92 of the cooling unit 90 is driven, air discharged through the exhaust port 941 of the cooling unit 90 is delivered through the inflow opening 7221 into the cooling duct 722. The air flows within the cooling duct 722 from the inflow opening 7221 to the outflow opening 7222. The air stream flowing in the cooling duct 722 impinges on lower part of the developing device 40. That is, the cooling duct 722 cools the developing device 40 by making the air stream flow through.

As shown in FIGS. 10 and 11, whether the developing roller 47 has got further separate from the photosensitive drum 21 or nearer to the photosensitive drum 21, the developing holder 70 is displaced about the axis of the swinging shaft part 73 along with the developing device 40. As a result, it becomes possible to prevent generation of any gap in an opposing area between the developing device 40 and the cooling duct 722. Accordingly, leakage of air flowing through the cooling duct 722 can be suppressed, so that the developing device 40 can be cooled with high efficacy.

Figure 15:
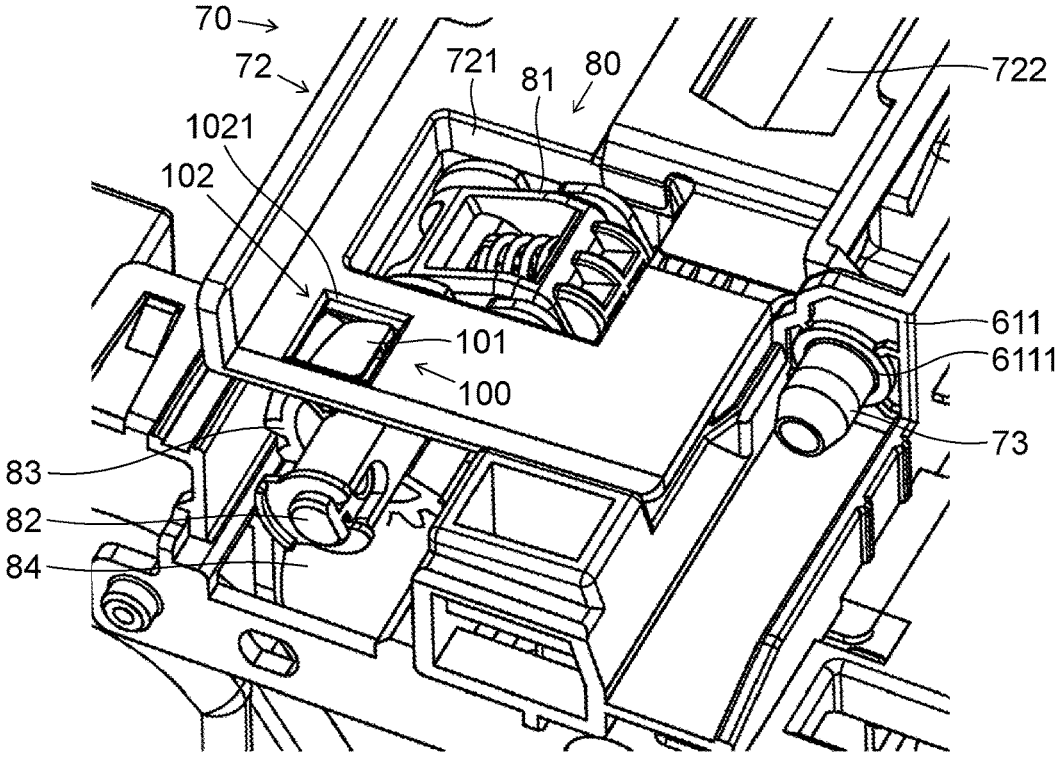
FIG. 15 is a perspective view showing a vicinity of a developing-device moving mechanism in the image forming apparatus according to an embodiment of the disclosure.
Figure 16:
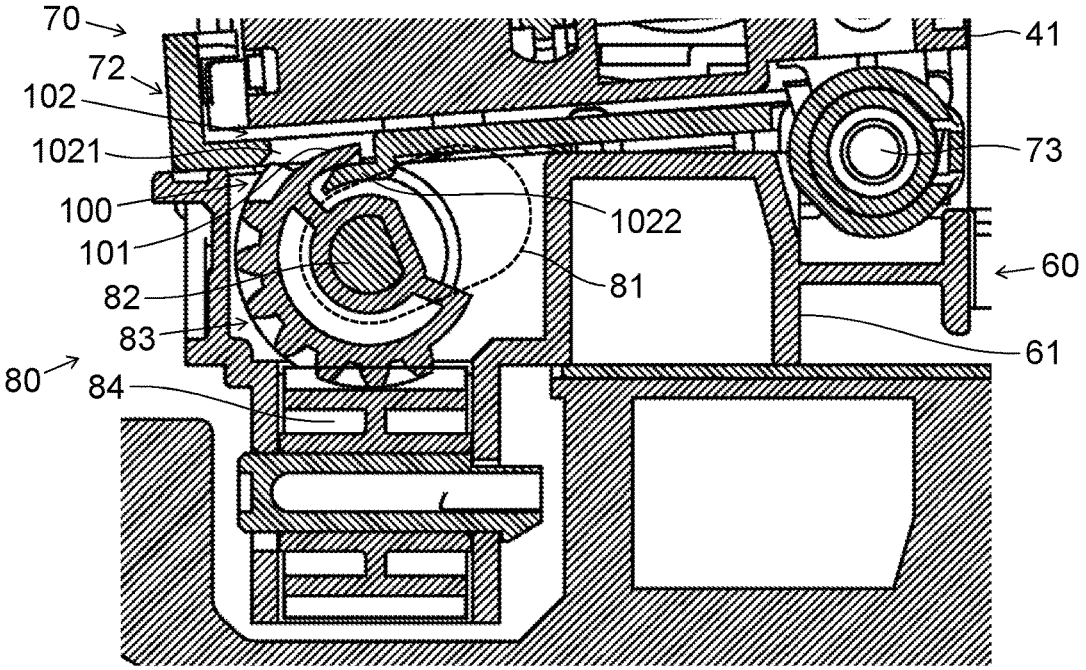
FIG. 16 is a partial cross-sectional front view showing a vicinity of the developing-device moving mechanism in the image forming apparatus according to an embodiment of the disclosure, the view showing a state in which the developing roller is separated from the photosensitive drum.
Figure 17:
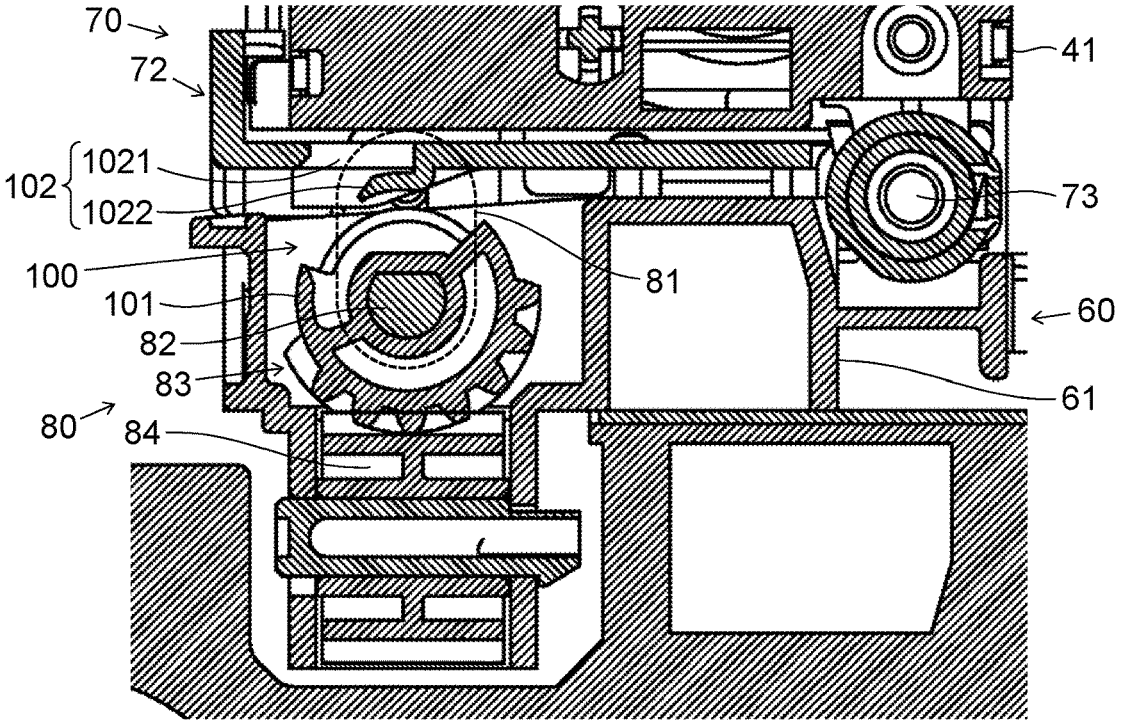
FIG. 17 is a partial cross-sectional front view showing a vicinity of the developing-device moving mechanism in the image forming apparatus according to an embodiment of the disclosure, the view showing a state in which the developing roller has got near the photosensitive drum.

FIG. 15 is a perspective view showing a vicinity of the developing-device moving mechanism 80 in the image forming apparatus 1. FIG. 16 is a partial cross-sectional front view showing a vicinity of the developing-device moving mechanism 80 in the image forming apparatus 1, the view showing a state in which the developing roller 47 is separated from the photosensitive drum 21. FIG. 17 is a partial cross-sectional front view showing a vicinity of the developing-device moving mechanism 80 in the image forming apparatus 1, the view showing a state in which the developing roller 47 has got near the photosensitive drum 21.

As shown in FIGS. 15, 16 and 17, the developing-device moving mechanism 80 includes a contact/separable gear 83 and a cover-interlocked gear 84 in addition to the already described contact/separable cam 81 and cam shaft 82.

The contact/separable gear 83 is attached to the cam shaft 82. The contact/separable gear 83 is placed at a site on the cam shaft 82 frontward of the contact/separable cam 81. The contact/separable gear 83 is a so-called tooth-lacking gear in which plural teeth are arrayed on only part of its circumference. The contact/separable gear 83 meshes with the cover-interlocked gear 84. The contact/separable gear 83 transmits rotational force via the cam shaft 82 to the contact/separable cam 81.

The cover-interlocked gear 84 is placed under the contact/separable gear 83. The cover-interlocked gear 84 is provided in one or more quantity so as to mesh with an unshown cover gear provided on a pivotal shaft of the opening/closing cover 2*c*. That is, along with opening and closing of the opening/closing cover 2*c*, rotational force is transmitted from the cover gear to the cover-interlocked gear 84, and furthermore rotational force is transmitted to the contact/separable gear 83.

The image forming apparatus 1 includes a lock mechanism 100 shown in FIGS. 15, 16 and 17. The lock mechanism 100 includes a hook 101 and an engaging portion 102.

The hook 101 is provided in the contact/separable gear 83. The hook 101 is placed at the tooth-lacking portion of the contact/separable gear 83. The hook 101 extends so as to draw an arc from a tooth-bottom portion of the contact/separable gear 83 in its circumferential direction. The hook 101 is rotated in the circumferential direction of the contact/separable gear 83 along with rotation of the contact/separable gear 83. The contact/separable gear 83 has a space radially inward of the hook 101.

The engaging portion 102 is provided in the bottom support part 72 of the developing holder 70. The engaging portion 102 is placed at a site upward of the contact/separable gear 83 and opposed to the contact/separable gear 83. The engaging portion 102 includes an insertion opening 1021 and an engaging piece 1022.

The insertion opening 1021 extends through the bottom support part 72 of the developing holder 70 in the up/down direction. The insertion opening 1021 is so shaped and sized as to allow the hook 101 to be inserted therethrough. The engaging piece 1022 is placed adjacent to the insertion opening 1021 along the circumferential direction of the contact/separable gear 83 (i.e. left/right direction). The engaging piece 1022 is formed into a thin-plate shape extending in both the left/right direction and the front/rear directions.

As shown in FIG. 16, while the developing roller 47 is separate from the photosensitive drum 21, the contact/separable cam 81 is in its laid-down state, having been turned clockwise more than in its raised-up state in FIG. 16. As a result, the hook 101 goes through the insertion opening 1021 so as to be aground on the upper side of the engaging piece 1022 and mesh with the engaging portion 102. That is, the lock mechanism 100 locks a displacement of the developing device 40.

As shown in FIG. 17, while the developing roller 47 keeps near the photosensitive drum 21, the contact/separable cam 81 is in its raised-up state, having been turned counterclockwise more than in the laid-down state as viewed in FIG. 17. As a result, the hook 101 is separated from the engaging piece 1022 so as to be released from meshing with the engaging portion 102. That is, the lock mechanism 100 releases the locking of the displacement of the developing device 40.

As described above, the lock mechanism 100 locks a displacement of the developing device 40 in linkage with separation of the developing roller 47 from the photosensitive drum 21, and releases the locking of the displacement of the developing device 40 in linkage with nearing of the developing roller 47 to the photosensitive drum 21. Wth this arrangement, it becomes possible to lock a displacement of the developing device 40 upon fitting or removal of the developing device 40 to or from the developing holder 70, so that swings of the developing device 40 about the axis of the swinging shaft part 73 can be suppressed. Accordingly, it becomes possible to prevent the developing device 40 from unintentionally swinging and coming into contact with the photosensitive drum 21 upon fitting or removal of the developing device 40 to or from the developing holder 70. Thus, damage of the outer circumferential surface of the photosensitive drum 21 can be prevented.

Further, as to the lock mechanism 100, the hook 101 meshes with the engaging portion 102 in linkage with separation of the developing roller 47 from the photosensitive drum 21 to lock a displacement of the developing device 40, and releases the meshing between the hook 101 and the engaging portion 102 in linkage with nearing of the developing roller 47 to the photosensitive drum 21 to release the locking of the displacement of the developing device 40. With this arrangement, it becomes possible to fulfill meshing and mesh-releasing between the hook 101 and the engaging portion 102 by using rotation of the contact/separable gear 83 intended for transmission of rotational force to the contact/separable cam 81, so that locking and lock-releasing of a displacement of the developing device 40 can be fulfilled. Accordingly, unintentional swings of the developing device 40 can be suppressed without newly providing a power transmission mechanism for fulfillment of locking and lock-releasing of a displacement of the developing device 40.

Although an embodiment of the present disclosure has been described hereinabove, yet the scope of the disclosure is not limited to this, and the disclosure may be carried out with various changes and modifications applied thereto unless those changes and modifications depart from the gist of the invention.

For example, in the above embodiment, it is assumed that the image forming apparatus 1 is an image forming apparatus of the so-called tandem type for color printing use capable of forming images by successively superimposing plural-color images one on another. However, the image forming apparatus is not limited to such types. The image forming apparatus may be an image forming apparatus of a non-tandem type for color printing use or an image forming apparatus for monochrome printing use.

What is claimed is:

1. An image forming apparatus comprising:

an image carrier unit including an image carrier;

a developing device which includes a developer carrier for supplying toner onto an outer circumferential surface of the image carrier and which is placed in adjacency to the image carrier unit;

a unit support frame for supporting the image carrier unit and the developing device such that the image carrier unit and the developing device are fittable thereto and removable therefrom individually; and a developing holder which is provided on the unit support frame and which holds the developing device such that the developing device is swingable in a direction that allows the developer carrier to get nearer to or further separate from the image carrier, wherein the developing holder includes:

a driving gear for transmitting motive power to the developing device; and a pair of swinging shaft parts which have a rotational axis extending parallel to an axial direction of the developer carrier and which are supported rotatable relative to the unit support frame, and an axial distance between the pair of swinging shaft parts is longer than a distance from a rotational center of the driving gear to a rotational center of the swinging shaft parts.

2. The image forming apparatus according to claim 1, wherein the axial distance between the pair of swinging shaft parts is longer than an axial length of the developer carrier.

3. The image forming apparatus according to claim 1, wherein the developing holder includes a cooling duct which extends parallel to the axial direction of the developer carrier and which allows an air current to flow therethrough to cool the developing device.

4. The image forming apparatus according to claim 1, further comprising:

a developing-device moving mechanism for making the developing device swing about the axis of the swinging shaft parts so that the developer carrier is brought nearer to or further separate from the developer carrier; and a lock mechanism for locking a displacement of the developing device in linkage with separation of the developer carrier from the image carrier, and releasing locking of a displacement of the developing device in linkage with nearing of the developer carrier to the image carrier.

5. The image forming apparatus according to claim 4, wherein the developing-device moving mechanism includes:

a contact/separable cam which is to be rotated, while keeping in contact with the developing device, to displace the developing device, thereby allowing a distance between the image carrier and the developer carrier to be changed; and a contact/separable gear for transmitting rotational force to the contact/separable cam, and the lock mechanism includes:

a hook which is provided in the contact/separable gear and which is rotated in a circumferential direction of the contact/separable gear along with rotation of the contact/separable gear; and an engaging portion provided at a site in the developing holder opposed to the contact/separable gear, and the hook meshes with the engaging portion in linkage with separation of the developer carrier from the image carrier to thereby lock a displacement of the developing device, and releases meshing between the hook and the engaging portion in linkage with nearing of the developer carrier to the image carrier to thereby release locking of the displacement of the developing device.

* * * * *